United States Patent [19]

Salomon

[11] 4,166,637

[45] Sep. 4, 1979

[54] DEVICE FOR HOLDING A BOOT TO A SPORTS ARTICLE

[75] Inventor: Georges P. J. Salomon, Annecy, France

[73] Assignee: Etablissements Francois Salomon et Fils, Annecy, France

[21] Appl. No.: 793,618

[22] Filed: May 4, 1977

[51] Int. Cl.[2] ..... A63C 9/10; A63C 9/085

[52] U.S. Cl. ..... 280/625; 248/505; 269/321 ME; 280/618; 280/631

[58] Field of Search ..... 280/631, 632, 617, 618, 280/619, 620, 625, 605, 11.37 E, 615, 614, 623; 24/265 R; 248/505, 510; 269/321 CF, 321 ME

[56] References Cited

U.S. PATENT DOCUMENTS

| | | | |
|---|---|---|---|
| 2,199,153 | 4/1940 | Else | 280/615 |
| 3,481,618 | 12/1969 | With | 280/615 |
| 3,866,928 | 2/1975 | Gertsch et al. | 280/618 |
| 4,013,304 | 3/1977 | Begey et al. | 280/618 |
| 4,043,570 | 8/1977 | Riikonen | 280/615 |

FOREIGN PATENT DOCUMENTS

| | | | |
|---|---|---|---|
| 1246035 | 10/1960 | France | 280/623 |

*Primary Examiner*—David M. Mitchell

*Attorney, Agent, or Firm*—Pollock, Vande Sande & Priddy

[57] ABSTRACT

A device for holding an object, such as a boot, to a support, more particularly a sports article, is designed in a manner such that the resilient member providing the necessary energy to hold the object to the support has two pivoting sections with axes coinciding in the plane of the support, the sections being united by a resiliently deformable loop. The sections and the loop are preferably in the form of a bent rod. The device may be used more particularly to hold a boot to a ski.

19 Claims, 7 Drawing Figures

DEVICE FOR HOLDING A BOOT TO A SPORTS ARTICLE

The present invention relates to a device for holding an object, more particularly a boot, between two elements, at least one of which is movable in relation to the other, one of the elements being a means of support, more particularly a ski, while the other is a pressure part hinged in relation to the means of support and designed to be applied to the object to be held with sufficient force to obtain either adequate retention of the object to prevent it from being separated from the means of support, or a safety release.

For producing this holding force, the device comprises, conventionally, a resilient means acting between the two elements which are movable in relation to each other, the resilient means being designed to apply to the object a resilient holding force in a specific direction.

Numerous designs of holding devices of the type mentioned above are already known, but these known devices have a large number of hinged or sliding parts governed by one or more springs and having stops to restrict the movements thereof. These known devices are therefore of complex design, which results, on the one hand, in high manufacturing costs, and (b) on the other hand, in a risk of malfunction due to the large number of parts moving in relation to each other.

It is an object of the present invention to overcome these disadvantages by providing holding devices of simple and rugged construction with a limited number of moving parts.

The present invention relates to a holding device of the general type mentioned above, wherein the resilient means comprises at least two pivoting parts housed in one of the two elements along axes such that the planes at right angles to these axes are concurrent, and one part uniting the pivoting parts and connecting them to the other element.

As a result of this arrangement, any load applied, either to the pivoting parts or to the connecting part of the resilient means, brings about a change in their respective positions causing at least partial resilient deformation of the resilient means which thus opposes the load.

The pivoting parts preferably consist of sections pivoting in housings in the corresponding element, the connecting part being in the form of a loop which is at least partially deformable.

In other words, it may be said that the main idea of the present invention is that the resilient means of the device consists of two pivoting parts and a loop constituting the remainder of the device, in such a manner that a load produces resilient, reversible deformation of the resilient means as soon as the latter leaves a position of stable equilibrium corresponding to a predetermined configuration.

As already indicated, this resilient deformation is brought about by the fact that displacement of the connecting part, i.e., the loop, is prevented as it rotates about the axis of one of the pivoting sections, this being achieved, according to the invention, by the existence of the second pivoting section.

The general arrangement of the resilient means according to the invention may vary widely, depending upon the purpose for which the holding device is to be used.

However, the resilient means, with its sections and loop, will preferably be in the form of a one-piece rod shaped in such a manner that the pivoting sections extend from each end of the loop. Furthermore, the pivoting sections shall be such that the planes perpendicular to these sections shall be concurrent. The sections may be located in the plane of the loop, but are preferably in a separate plane.

According to one particularly simple embodiment of the invention, the element constituting the pressure part is integral with the resilient means.

The device according to the invention has numerous applications. It may be used, for example, in holding systems for the purpose of pre-positioning a pressure part, for automatically adapting the device to the boot, especially to the sole-thickness thereof, and for providing lateral, vertical, or longitudinal retention (with or without safety release). Such holding devices may be used either directly upon the ski, upon an intermediate plate releasable in relation to the ski, or upon any element requiring the retention of the boot, more particularly for drilling templets for fitting bindings to the ski, for ice crampons, for means for supporting the boots during transportation, for roller skates, for ice skates, etc.

A description will now be given, by way of non-restrictive example, of a plurality of embodiments of the invention, with reference to the drawings attached hereto, wherein.

In the following description, it will be assumed that the device according to the invention was designed to hold a boot to a means of support marked 1 as a whole, which, in the example illustrated, is a ski.

It will be understood, however, that means of support 1 could also be an intermediate plate united temporarily with a boot, the plate being then secured to the ski by means of bindings of conventional design.

Figure 1:
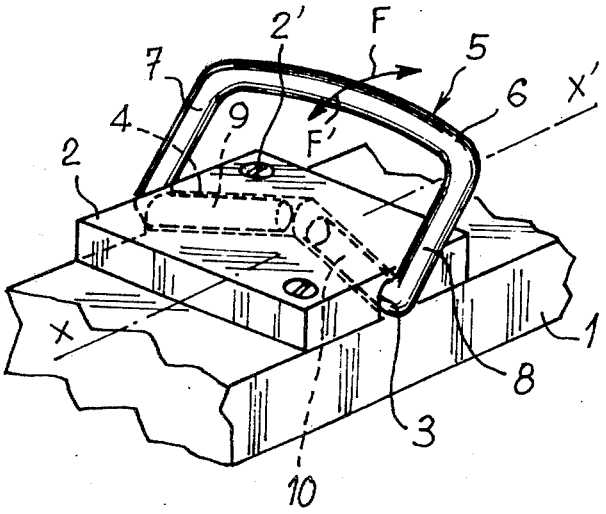
FIG. 1 shows a first embodiment of a device according to the invention designed, more particularly to hold the front of a boot to a ski, with no provision for release.

FIG. 1 shows a baseplate 2 secured by screws 2' at right angles to the longitudinal axis XX' of the ski.

Baseplate 2 has two housings 3,4 of circular cross section which converge towards longitudinal axis XX' and form between themselves an angle $\alpha$ of less than 180°.

A metal rod, generally marked 5, is shaped to provide a cross-piece, or central piece, which constitutes the pressure part and which will be in contact with the boot, the cross-piece being extended by two lateral arms 7,8 running substantially parallel with each other and terminating in endsections 9,10 rotatably received in housings 3,4 in baseplate 2.

End-sections 9,10 run in a plane substantially parallel with the plane of the ski and form, in the neutral position, an angle with the plane defined by arms 7,8 and cross-piece 6. Both sections may equally well be located in the same plane coinciding with the surface of the ski, but may also be located in two different planes. In the proposed design, the two sections are located symmetrically in relation to the longitudinal axis of the ski, but they may also be arranged asymmetrically. With the boot removed from the ski, the device assumes the position shown in FIG. 1, i.e., cross-piece 6 is raised above the ski.

When the skier engages his boot in the loop formed by cross-piece 6 and arms 7,8, the load applied to the cross-piece, in the direction of arrow F, for example, will urge the loop towards the ski.

The presence of pivoting sections 9,10 will oppose any movement of the loop in the direction of arrow F by the resilient deformation occurring between arms 7,8 and sections 9,10.

The holding device will thus generate a pressure force F′ opposing the force F applied by cross-piece 6 to the boot.

It will be observed that, because of its resilient mobility, the device shown in FIG. 1 makes it possible to hold boots properly regardless of the thickness of their soles.

Figure 2:
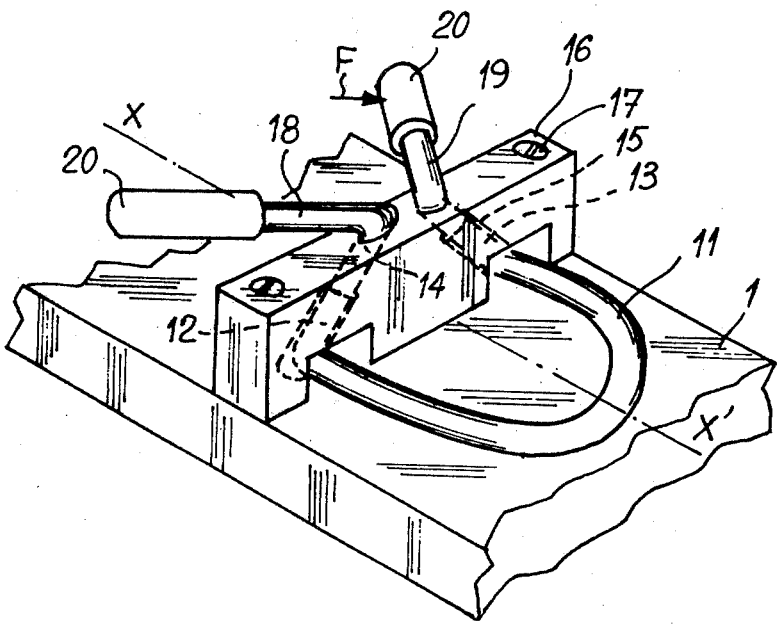
FIG. 2 shows a second embodiment of the invention designed to hold the front of a boot to a ski, with provision for lateral release.

FIG. 2 relates to a device also designed to cooperate with the front of a boot, but which provides for lateral safety release of the front of the boot.

In this embodiment, the holding device consists, as in FIG. 1, of a metal rod, preferably of circular cross section, comprising a central loop 11 designed to bear against the upper surface of ski 1, the loop being extended by two sections 12,13 accommodated rotatably in housings 14,15 in a vertical plate 16 secured to the ski by screws 17. Housings 14,15 are located in a plane at right angles to the longitudinal axis XX′ of the ski, and they converge towards a vertical axis perpendicular to axis XX′. Each section 12,13 is extended, above plate 16, by and end-section 18,19, the end-sections being located in a horizontal plane parallel with the plane of the ski and diverging laterally from the vertical axis. End-sections 18,19 are preferably fitted with sleeves 20 made of a plastic material and are designed to cooperate with the front of the boot.

The lower part of the sections adjoining loop 11 may move freely, possibly in the plane of the ski.

It will be observed that end-sections 18,19 will form, advantageously, an angle of about 90°, and that the assembly will be, as shown, symmetrical in relation to axis XX′ of the ski.

It will be understood that if, as a result of lateral torsion, a load is applied in the direction of arrow F to end 19, for example, the end will tend to pivot, in its plane, about housing 15.

Section 19 will thus tend to rotate about its axis and resilient deformation will take place in the vicinity of loop 11.

As soon as the load in the direction of arrow F ceases, the resilient preload of the device will restore end 19 to its original position.

A description will now be given, with reference to FIGS. 3 to 7, of an application in which the rear of a boot is held to a ski 1. In these embodiments, the pressure part is in the form of a jaw which is mobile in relation to the ski and is held resiliently by a resilient means in the form of one or more rods shaped to permit resilient deformation under load.

Figure 3:
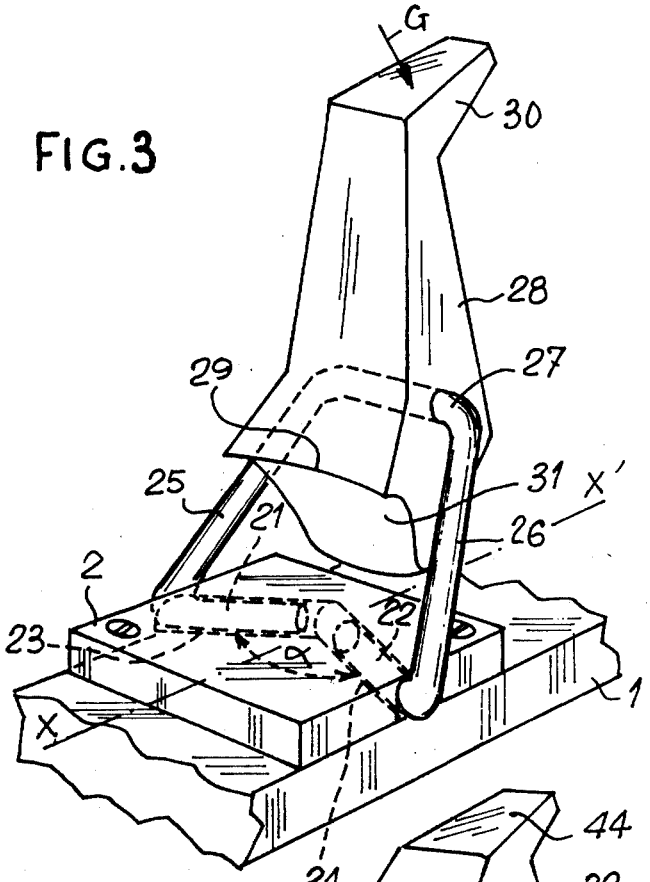
FIG. 3 shows another embodiment of the invention providing for the prepositioning of a mobile pressure part designed to hold the heel of the boot to the ski.

In the embodiment illustrated in FIG. 3, a resilient means, similar to that shown in FIG. 1, is mounted upon the ski by means of a baseplate 2. This resilient means consists of two end-sections 21,22 converging, in the plane of baseplate 2, towards the longitudinal axis XX′ of the ski, and pivotably received in housings 23,24 in the baseplate, the end-sections forming an angle $\alpha$ of less than 180°.

End-sections 21,22 are extended by lateral arms 25,26 united by a cross-piece 27 parallel with ski 1.

As in FIG. 1, end-sections 21,22 are therefore in a plane separate from that formed by arms 25,26 and cross-piece 27. Mounted pivotably upon cross-piece 27 is a pressure part 28 having a jaw 29, designed to be applied to the sole of the boot, and a lever 30 which may be moved in the direction of arrow G in order to release the boot voluntarily. The pressure part also has a pedal 31, located under jaw 29, which provides automatic fitting or "step-in".

In FIG. 3, the pressure part is shown in the boot-retaining position, although the boot itself is not shown for reasons of clarity. With the boot removed, of course, the pressure part assumes the pivoted position, with the jaw raised in relation to the plane of the ski.

In the embodiment illustrated in FIG. 3, release lever 30 is integral with the jaw, but it will be understood that it may be hinged to cross-piece 27 or to another axis arranged on the jaw for that purpose. In this case, the rotary motion of lever 30 would be limited by stops integral with pressure part 28 or with jaw 29.

Figure 4:
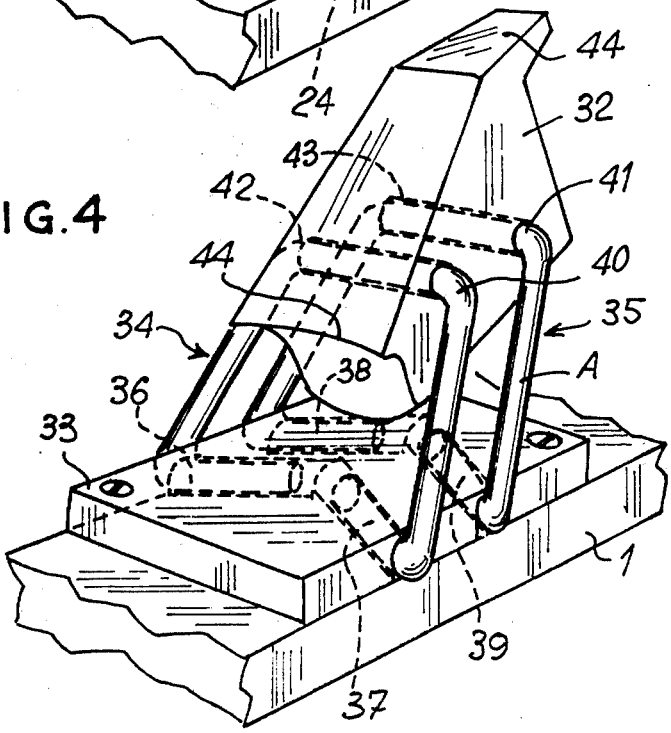
FIG. 4 shows a variant of a device designed for the same purpose as the device illustrated in FIG. 3.

In the embodiment illustrated in FIG. 4, pressure part 32 is similar to that in FIG. 3. However, this pressure part is connected to a baseplate 33 secured to ski 1 by resilient means indicated as a whole by 34 and 35, end-sections 36,37,38,39 thereof being parallel in pairs and being accommodated rotatably in the baseplate, whereas cross-pieces 40,41 are accommodated rotatably in two parallel passages 42,43 in pressure part 32.

It will be realized that pressure part 32, in its neutral position, will assume the position shown in FIG. 4, and that the engagement of a boot under jaw 44 will being about a displacement of part 32, this displacement depending upon the relative position of the two resilient means.

It will be noted that the pressure part also comprises a voluntary release lever 44 which makes it possible to apply to the jaw a load opposing the action of the resilient means.

Figure 5:
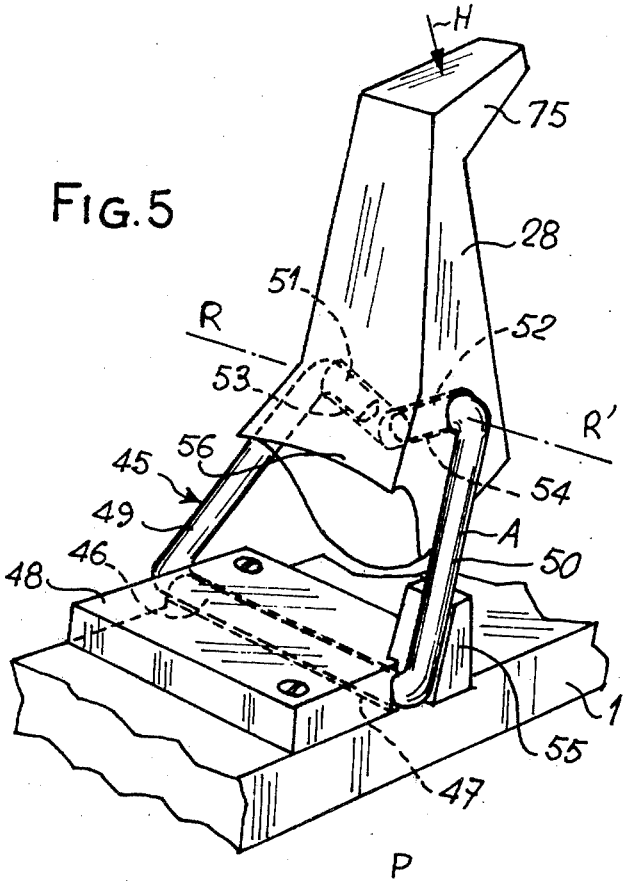
FIG. 5 shows another embodiment of the invention designed to cooperate with the rear of a boot held to a ski, with provision for safety release of the boot.
Figure 6:
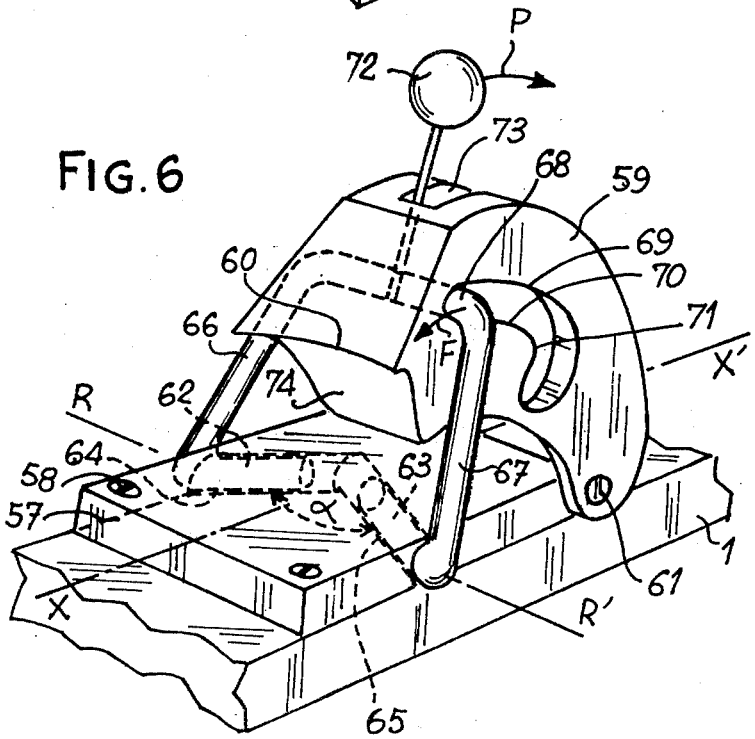
FIGS. 6 and 7 show another embodiment of the invention adapted to hold the rear of a boot to a ski, with provision for safety release.
Figure 7:
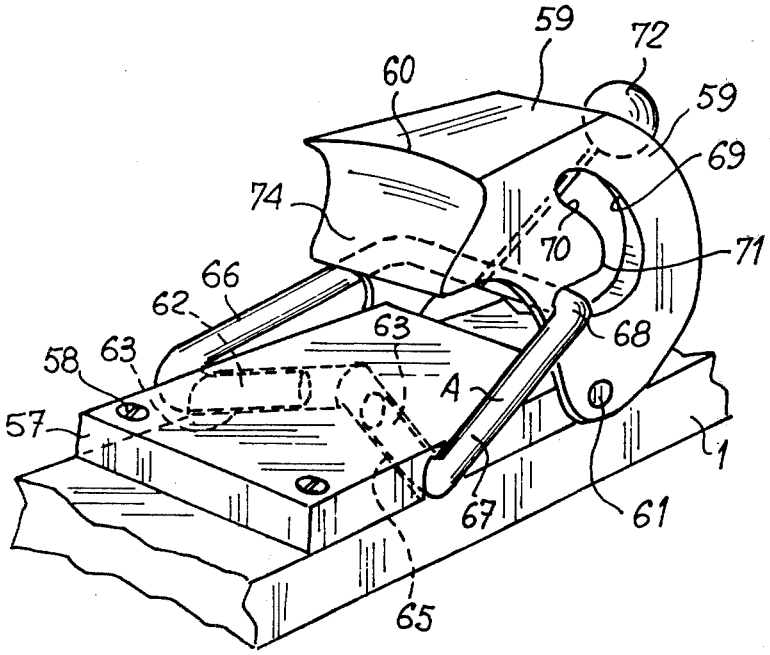

In the embodiments illustrated in FIGS. 5 to 7, the holding device allows the boot to be released when excessive stresses arise between the boot and the device.

In FIG. 5, a pressure part 28, similar to that in FIG. 3, is mounted pivotably upon the ski by a resilient means 45 in the form of a cylindrical rod bent and shaped to provide a central cross-piece 46 rotatably received in a housing 47 in a baseplate 48 secured to ski 1, the cross-piece being extended by lateral arms 49,50 and terminating in end-sections 51,52 accommodated pivotably in housings 53,54 in pressure part 28.

End-sections 51,52 are located in the plane formed by parts 46,49 and 50 of the resilient means, but are inclined towards each other in the direction of cross-piece 46. The end-sections could also be in a plane other than that of parts 46,49,50. Baseplate 48 has a stop 55 against which arm 50 of the resilient means comes to rest in the neutral position shown in FIG. 5. The pressure part is thus kept raised above the plane of the ski, and the resilient means presents a form of stable equilibrium.

It will be understood that when lever 75 is moved in the direction of arrow H, pressure part 28 will be caused to pivot about an axis RR' passing substantially through the bent parts uniting sections 51,52 to arms 49,50.

However, end-sections 51,52 will oppose the rotation of pressure part 28, because of their arrangement in relation to axis RR', and the shaped rod will therefore be deformed resiliently, the resilient deformation restoring pressure part 28 to the position shown in FIG. 5, as soon as the load in the direction of arrow H ceases. The same will, of course, apply when the boot applies a load to jaw 56 of the pressure part in the direction of a safety release.

After the safety release, the device will return to the position shown in FIG. 5, and all that the skier has to do to refit the ski is to move lever 75 in the direction of arrow H, in order to open the jaw, and to position his boot upon the ski; as soon as he releases the lever, the jaw will descend and hold the boot to the ski.

Cross-piece 46 may be made in two pieces, i.e., it may be cut in half, each half being locked in translation. The cross-piece could also be designed with an axis about which arms 50 and 49 would pivot.

In the embodiment illustrated in FIGS. 6 and 7, a baseplate 57 is secured by screws 58 to ski 1. A pressure part comprising a jaw 60 is mounted to pivot about an axis 61 on the baseplate running at right angles to the longitudinal axis XX' of the ski.

As in the embodiment illustrated in FIG. 3, the resilient means is in the form of a cylindrical metal rod shaped to provide two end-sections 62,63 mounted rotatably in housings 64,65 in the baseplate and forming an angle $\alpha$ of less than 180°, and a cross-piece 68, parallel with the plane of the ski, uniting arms 66,67.

In the normal neutral position, the shaped rod is in the stable condition shown in FIG. 6.

Cross-piece 68 passes through pressure part 59 in lateral slots, only one of which is shown at 69. Each slot 69 has a ramp 70 which comprises a release nose 71 with which the cross-piece cooperates in order to hold and release the boot.

FIG. 6 shows the device in the position in which it holds the boot, which is its normal position, since the shaped rod always tends to move in the direction of arrow F to reach a stable position. As a result of this, and by cooperating with the ramp, the rod urges the jaw of the holding element in a downward direction, i.e., into a depressed position.

The boot may be released voluntarily by moving the shaped rod, in a direction opposite to that of arrow F, by means of a lever 72 integral with cross-piece 68 and running in a slot 73 in pressure part 59. It will thus suffice to move lever 72 in the direction of arrow P in order to cause cross-piece 68 to rotate about an axis RR' at right angles to axis XX', which causes pressure part 59 to return to the position shown in FIG. 7. The configuration of ramp 70 is preferably such that, in the position shown in FIG. 7, where the jaw is open, the pressure part will be held back, so that pedal 74, on part 59, permits automatic step-in. This is made possible by the presence of release lug 71 which, once it has been passed, will keep pressure part 59 in the position shown in FIG. 7.

What is claimed is:

1. A device for holding an object between two elements at least one of which is movable in relation to the other, one of said elements being a means of support for the object while the other is a pressure member pivotable about at least one axis in relation to said means of support, comprising (a) a resilient means having at least one resiliently deformable portion and acting between said two elements and causing said pressure member to be applied to said object, said resilient applying to said object, through said pressure member, a resilient holding force upon deformation of said at least one deformable portion, said portion comprising (i) two pivoting parts connected to said pressure member, each said part being pivotable about an axis relative to said means of support; and (ii) two journalling parts each connected to one of said two elements along axes forming with the pivoting planes of the corresponding pivoting part an angle other than 90°, said journalling parts being so disposed that planes perpendicular to the axes of the parts converge and intersect in a line.

2. A device according to claim 1, wherein the respective pivoting parts and the corresponding journalling parts from one piece.

3. A device according to claim 2, wherein said journalling parts comprise two sections journalled in a housing in the corresponding element, whereas the pivoting part is in the form of an at least partly deformable loop.

4. A device according to claim 3, wherein said two journalling sections are located in the same plane.

5. A device according to claim 4, wherein said means of support has a plane for supporting said object, said journalling sections being located in a plane parallel with the plane of said means of support.

6. A device according to claim 4, wherein said means of support has a plane for supporting said object, said journalling sections being located in a plane intersecting with the plane of said means of support.

7. A device according to claim 4, wherein said pressure element is an integral part of said resilient means.

8. A device according to claim 1, wherein said journalling parts are housed rotatably in a plate arranged at right angles to said means of support, in a manner such that the axes of said parts both lie in a plane at right angles to said means of support.

9. A device according to claim 8, wherein said means of support has a plane and a longitudinal axis and wherein said journalling parts are interconnected by a rod in the shape of a deformable loop, said loop bearing against said means of support, the vertical plane containing the journalling parts being at right angles to the longitudinal axis of said means of support.

10. A device according to claim 9, wherein said journalled parts are extended above said means of support by ends located in a plane substantially parallel to that of said means of support and serving as said pivoting parts, said ends diverging from the longitudinal axis of said means of support in order to cooperate with the object to be held and at their extremities, to serve as a pressure member.

11. A device according to claim 1, wherein said pressure part comprises a jaw mobile in relation to a means of support having a longitudinal axis, said resilient means being in the form of a rod shaped to provide a central loop raised above said means of a support upon which said jaw is mounted for free rotation, said loop having two pivoting parts terminating in two journalling parts pivotably housed in said means of support, the axes of said journalling parts converging and intersecting towards the longitudinal axis of said means of support, said axes forming with the pivoting plane of said pivoting parts an angle other than 90°.

12. A device according to claim 1, wherein said pressure part comprises a jaw mobile in relation to said means of support, said means of support having a longitudinal axis and a plane for supporting said object, said resilient means being in the form of two independent rods shaped to provide, respectively, a central loop raised above said means of support and having a cross piece extending laterally with two pivoting parts, the parallel cross-pieces of these loops passing in free rotation through said jaw, each loop terminating in two cylindrical journalling parts housed pivotably in the plane of said means of support, one journalling part of one loop being parallel with one journalling part of the other loop, and the axes of said journalling parts of each of said loops converging and intersecting towards the longitudinal axis of said means of support, said axes forming with the pivoting plane of said pivoting parts an angle other than 90°.

13. A device according to claim 1, wherein said means of support comprises a ski and said pressure part comprises a jaw movable in relation to said ski, said ski having a longitudinal axis and a plane for supporting a boot, said resilient means comprising a rod shaped to provide a central loop housed rotatably in the plane of said ski and at right angles to the longitudinal axis thereof, said central loop being extended by two lateral pivoting arms terminating in journalling sections housed in symmetrical orifices in the lateral surfaces of said pivoting jaw, the axes of said journalling sections converging towards the longitudinal axis of said ski.

14. A device according to claim 13, including a stop integral with said ski for maintaining said shaped rod in a raised position above said ski when the boot is not being fitted.

15. A device according to claim 1, wherein the pressure part comprises a jaw pivoting about an axis at right angles to the longitudinal axis of said means of support, said jaw cooperating with a resilient means in the form of a rod shaped to provide two end sections journalled in the plane of said means of support, the axes of said end sections intersecting upon the longitudinal axis of said means of support, said sections being united by a loop comprising a cross-piece mounted for movement in a cam-like slot in said jaw.

16. A device according to claim 15, including an actuating lever integral with said resilient means for controlling the movement of said cross-piece of said resilient means in the slot in the jaw.

17. A device for holding an object between two elements, at least one of which is movable in relation to the other, one of said elements being a means of support for said object and having a plane for supporting said object, while the other is a pressure member pivotable about at least one axis in relation to said means of support and adapted to be applied to the object to be held by a resilient means acting between said two elements and adapted to apply to said object, through said pressure member, a resilient holding force upon deformation of at least one resiliently deformable portion of said resilient means, said resilient means and said pressure member being in the form of a single rod shaped to provide:

(a) two pivoting parts pivotable about an axis relative to said support, said pivoting parts being interconnected by a portion of said pressure member, said pivoting parts and said pressure member comprising a loop extending above the plane of the means of support, and (b) two bent extensions of said pivoting parts comprising journalling parts, said extensions being rotatably received in corresponding housings in the plane of the means of support along intersecting axes forming with the pivoting plane of the corresponding pivoting part an angle other than 90°.

18. A device according to claim 17, wherein said means of support has lateral sides and a longitudinal axis along which the boot is held, said journalling parts extending respectively from one of the lateral sides of said means of support towards the longitudinal axis thereof.

19. A device according to claim 17, wherein each pivoting part is substantially, perpendicular to the extending bent journalling part.

* * * * *